US009373319B2

(12) United States Patent
Jung

(10) Patent No.: US 9,373,319 B2
(45) Date of Patent: Jun. 21, 2016

(54) DEVICE FOR INFLUENCING PASSENGER COMPARTMENT NOISE

(71) Applicant: GM GLOBAL TECHNOLOGY OPERATIONS LLC, Detroit, MI (US)

(72) Inventor: Oliver Jung, Griesheim (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 142 days.

(21) Appl. No.: 14/109,264

(22) Filed: Dec. 17, 2013

(65) Prior Publication Data

US 2014/0169578 A1 Jun. 19, 2014

(30) Foreign Application Priority Data

Dec. 17, 2012 (DE) ..... 10 2012 024 615

(51) Int. Cl.
*G10K 11/16* (2006.01)
*G10K 11/178* (2006.01)
*G10K 15/02* (2006.01)

(52) U.S. Cl.
CPC ..... *G10K 11/178* (2013.01); *G10K 15/02* (2013.01); *G10K 2210/12821* (2013.01)

(58) Field of Classification Search
CPC ..... G10K 2210/1282; G10K 11/1788
USPC ..... 381/71.4
See application file for complete search history.

(56) References Cited

U.S. PATENT DOCUMENTS 6,269,289 B1 * 7/2001 Toukura et al. ..... B60W 30/188 701/1
2012/0076314 A1 * 3/2012 Reilly et al. ..... G10K 15/02 381/71.4

FOREIGN PATENT DOCUMENTS

EP 0469023 B2 2/1992
EP 1393960 A2 * 3/2004 ..... F16H 61/66

OTHER PUBLICATIONS

German Patent Office, German Patent Search Report for Application No. 102012024615.3, dated Aug. 20, 2013.

* cited by examiner

*Primary Examiner* — Simon King
(74) *Attorney, Agent, or Firm* — Ingrassia Fisher & Lorenz PC

(57) ABSTRACT

A device is provided for influencing the passenger compartment noise in a motor vehicle includes, but is not limited to a noise signal generator for generating an offsetting noise signal, which includes, but is not limited to a control input for receiving a control signal that is representative of the engine load of the motor vehicle, and a loudspeaker for receiving the offsetting noise signal and emitting an offsetting noise into the passenger compartment of the motor vehicle. The noise signal generator furthermore includes, but is not limited to an input for a temperature signal of a temperature sensor and is equipped to generate the offsetting noise signal as a function of a signaled temperature.

7 Claims, 1 Drawing Sheet

DEVICE FOR INFLUENCING PASSENGER COMPARTMENT NOISE

CROSS-REFERENCE TO RELATED APPLICATION

This application claims priority to German Patent Application No. 10 2012 024 615.3, filed Dec. 17, 2012, which is incorporated herein by reference in its entirety.

TECHNICAL FIELD

The technical field relates to a device for influencing the passenger compartment noise in a motor vehicle.

BACKGROUND

There are various classes of such devices, on the one hand such that dampen the noise level in the passenger compartment of a vehicle, in that relative to a noise entering from the outside they emit an inversely phased offsetting noise into the passenger compartment, on the other hand such that selectively amplify or complement the noise entering from the outside in order to offer the passengers a desired auditory impression.

A preferred field of application however are devices of the latter class, such as known from EP 0469 023 B2 for example. This document describes a device for influencing the passenger compartment noise, which can be activated through a control signal representing a throttle valve movement or gear change, in order to render the operating noise of a racing car or of another high-performance road vehicle audible in the passenger compartment.

A skilled driver extracts information, often instinctively, from the cab noise, which facilitates his handling of the vehicle. The noise spectrum that is audible while driving for example makes possible drawing a conclusion regarding the travelling speed, which makes it easier for the driver to keep the travelling speed just under an approved maximum speed, without continuously having to follow the speedometer display. Unusual components of the passenger compartment noise can point to a technical malfunction. Conventional devices for influencing passenger compartment noise, regardless of whether they reduce or alienate the latter, render it more difficult for the driver to extract useful information from the passenger compartment noise.

In view of the foregoing, at least one object is to state a device for influencing passenger compartment noise, which makes it easier for the driver to extract such information instead of making it more difficult. In addition, other objects, desirable features and characteristics will become apparent from the subsequent summary and detailed description, and the appended claims, taken in conjunction with the accompanying drawings and this background.

SUMMARY

A device is provided for influencing the passenger compartment noise in a motor vehicle with a noise signal generator for generating an offsetting noise signal, which comprises at least one control input for receiving a control signal that is representative for the engine load of the motor vehicle, and comprises at least one loudspeaker for receiving the offsetting noise signal and emitting an offsetting noise into the passenger compartment of the motor vehicle the audio signal generator furthermore comprises at least one input for a temperature signal and is equipped to generate the offsetting noise signal as a function of a signaled temperature.

Based on the realization that the passenger compartment noise, insofar as it originates from sources within the vehicle, is also clearly determined through the temperature to which these sources are exposed, but that this temperature in general does not constitute a quantity that is relevant to the driver. In that the device makes possible adapting the offsetting noise signal to the signaled temperature, it simultaneously allows reducing the dependency of the entire passenger compartment noise, which is composed of the offsetting noise and noise transmitted via air or structure-borne sound-transmitting parts of the vehicle from the respective noise sources into the passenger compartment. In that, however, the temperature dependency of the passenger compartment noise is eliminated or at least diminished it is simpler for the driver to learn and take into account while driving the relationship between the passenger compartment noise and other parameters such as travelling speed, transmission rotational speed, etc.

The input for the temperature signal can in particular be connected to an outside temperature sensor, an oil temperature sensor or temperature sensors that are arranged on the inlet air or exhaust line of the engine, in particular on a compressor, a turbine, an exhaust gas filter or catalytic converter. The input for the temperature signal can be formed by a digital data bus such as for example a CAN-bus, which connects the temperature sensor(s) to the noise signal generator and possibly to other devices of the vehicle, which utilize such a temperature signal.

A mixer for superimposing the offsetting noise signal with an audio signal is preferentially connected upstream of the loudspeaker. This makes possible utilizing one and the same loudspeaker, preferentially simultaneously, for emitting the offsetting noise and for reproducing a sound recording. In order to minimize the dependency of the passenger compartment noise on the signaled temperature, the noise signal generator is preferentially equipped to control the volume of the offsetting noise opposite to the dependency of the volume of an operating noise passively transmitted into the passenger compartment on the signaled temperature.

In order to render not only the total volume, but also the sound spectrum of the passenger compartment noise as independent as possible from the temperature, the noise signal generator is preferentially equipped to carry out controlling the volume for various frequency ranges independently of one another.

BRIEF DESCRIPTION OF THE DRAWINGS

The present invention will hereinafter be described in conjunction with the following drawing figures, wherein like numerals denote like elements, and.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
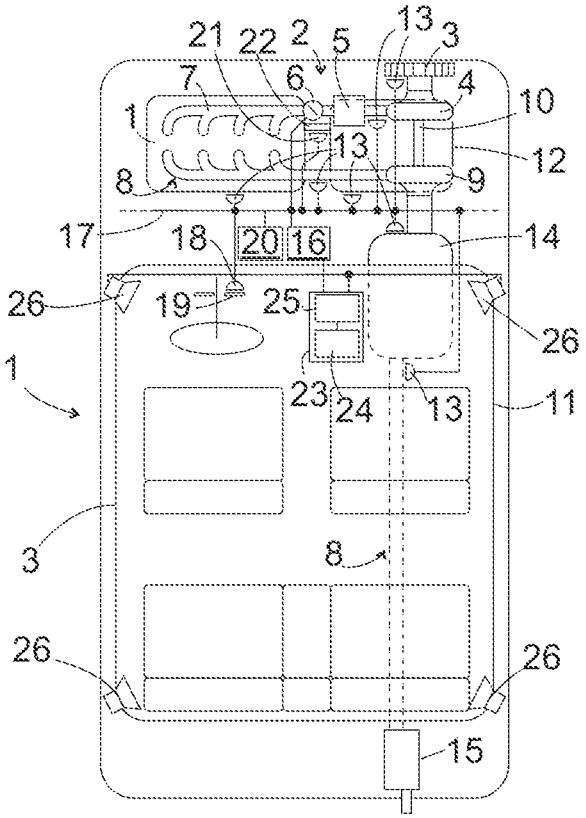
FIG. 1 is a block diagram of a motor vehicle with a device according to an embodiment for influencing the passenger compartment noise.

FIG. 1 schematically shows a vehicle having a device for influencing the passenger compartment noise. An internal combustion engine, in particular a spark-ignition or diesel engine of the vehicle is designated 1. On an inflow line 2 of the engine 1, the following are arranged in series: an air filter 3, compressor 4, a charge air cooler 5, a throttle valve 6 and an intake manifold 7, which distributes the charge air over the cylinders of the engine 1. On an exhaust line 8 of the engine 1, a turbine 9 and an exhaust catalytic converter 14 or particle filter are arranged. The exhaust gas expanding in the turbine 9 drivers the compressor 4 via a shaft 10 in a manner known per se element.

The travelling noise that is audible in a cab 11 of the vehicle is composed of contributions of various sources, in particular of the engine 1, of a transmission 12 driven by the engine 1 and of a drive train connected downstream and extending to driven wheels of the vehicle, of the wheels in contact with the road surface and the various components arranged on intake airline and exhaust line of the vehicle. In the case under consideration here, the operating noises of the compressor 4 and of the turbine 9 in particular are temperature-dependent, since the mass of the gas put through the converter 4 and turbine for each revolution of the shaft 10 greatly depends on the temperature of the sucked-in air, i.e. on the ambient temperature. However, other components also have a temperature-dependent noise development, which is why the invention in its applicability is not restricted to compressor vehicles. Thus, the ease of operation of the cylinders of the engine 1 and of the transmission 12 is dependent on the temperature of the lubricating oil circulating therein, which likewise has an influence on the noise development.

Temperature sensors can be provided on the vehicle in a multiplicity of locations. For sensing the ambient temperature, a temperature sensor 13 can for example be arranged directly on the air filter 3 or on a section of the intake air line 2 extending from the air filter 3 to the compressor 4. Also conceivable is a placement between the compressor 4 and the charge air cooler 5 for sensing the charge air temperature after compression. Temperature sensors 13 can be provided on the exhaust line directly on the exhaust manifold, between engine 1 and turbine 9. A temperature sensor 13 usually provided on the catalytic converter 14 or particle filter for monitoring the catalytic converter function or the regeneration of the particle filter can also be employed for a secondary usage within the scope of the present invention. A temperature sensor 13 cannot least be arranged also downstream of the catalytic converter 14, for example between the latter and a muffler 15.

Temperature sensors 13 for monitoring oil or cooling water can be placed on the engine 1 or the transmission 12. The various temperature sensors 13 communicate with a noise signal generator 16 and if appropriate other components of the vehicle which are not shown in the figure via a digital bus, e.g. a CAN-bus 17.

A load sensor 18 is shown arranged on an accelerator pedal 19 in FIG. 1; a signal supplied by this sensor 18 and indicating the position of the pedal 19 is utilized by an engine control unit 20 in a manner known per se in order to likewise via the bus 17, control the throttle valve 6. The noise generator signal 16 can via the bus 17 directly receive the position signals of the sensor 18, an adjusting signal derived by the engine control unit 20 from this and addressed to the throttle valve 6 or feedbacks of the throttle valve 6, which in each case indicates the respective set position of the throttle valve 6, in order to draw conclusions regarding the engine load from this.

A rotational speed sensor 21 is arranged on a shaft 22 connecting the internal combustion engine 1 to the transmission 12 and connected to the bus 17. In this way, the noise signal generator 16 can also receive information regarding the rotational speed of the engine via the bus 17.

The noise signal generator 16 generates an offsetting noise signal with the help of the received data relating to the engine load and if applicable rotational speed and one or a plurality of measured temperatures. To this end, it can comprise various oscillators or memory modules that can be matched in frequency and range, in which digitized noise signals are stored and which, continuously read out and weighted with load-dependent amplitudes, are superimposed on one another in order to form the offsetting noise signal.

An audio or infotainment system 23 of the vehicle comprises one or a plurality of audio signal sources 24, such as for example a car radio, a playback device for CDs, MP3-files or the like, and an amplifier 25 with a plurality of inputs for audio signals of the sources 24 and the offsetting noise signal of the noise signal generator 16. An output of the amplifier 25 is connected to loudspeakers 26 distributed in the passenger compartment 11 in order to reproduce the offsetting noise signal and, in the event that one of the sources 24 is in operation, its audio signal which is superimposed on the offsetting noise signal.

Figure 2:
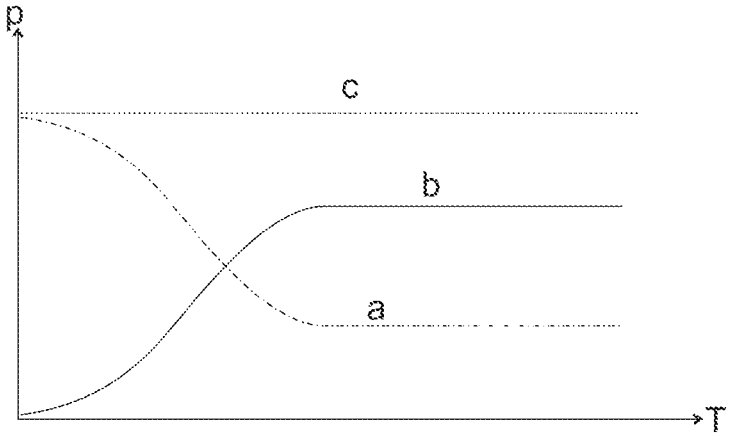
FIG. 2 is a diagram showing the sound pressure as a function of the temperature for a noise source of the vehicle, for the device for influencing the passenger compartment noise and for the total passenger compartment noise.

FIG. 2 schematically shows the relationship between sound pressure p and operating temperature T for one of the abovementioned noise sources engine 1, compressor 4 etc. as a curve a. The noise signal generator 16 is equipped in order to supply an offsetting noise signal with the same spectral composition as the operating noise of the noise source that is audible in the passenger compartment 11 but with respect to a horizontal axis, in mirrored temperature dependency, corresponding to a curve b, so that the entire passenger compartment noise that is audible in the passenger compartment 11 and formed through an incoherent superimposition of the contributions of the noise source and of the noise signal generator 16, represented as curve c, no longer has any dependency on the temperature.

The relationship between operating temperature and sound pressure can be different for various ranges of the audible frequency spectrum. Since the spectral composition of the operating noise of the various noise sources is also variable over time in particular as a function of the engine rotational speed in general, different relationships each between operating temperature and sound pressure can apply for various spectral ranges. Accordingly, the offsetting of the temperature influence can take place in that the noise signal generator 16 initially estimates the sound pressure of the operating noise for various spectral ranges with the help of the engine load and the rotational speed, then multiplies this value by a factor which corresponds to the ratio of the curves a and b at the current temperature, synthesizes the offsetting noise with the sound pressure thus obtained, outputting it via the loudspeakers 26.

In that the dependency of the passenger compartment noise on the temperature is thus substantially eliminated, the perceptibility of other quantities influencing the noise spectrum is rendered easier for the driver, so that in particular drawing a conclusion regarding the vehicle speed from the heard noise is facilitated.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A device for influencing the passenger compartment noise in a motor vehicle, comprising:

a noise signal generator that is configured to generate an offsetting noise signal; and loudspeaker that is configured to receive the offsetting noise signal and emitting an offsetting noise into the passenger compartment of the motor vehicle, wherein the noise signal generator comprises an input for a temperature signal and is equipped to generate the offsetting noise signal as a function of a signaled temperature;

wherein the input for the temperature signal is connected to an outside temperature sensor; and wherein the noise signal generator is configured to control a volume of the offsetting noise opposite to a dependency of a second volume of an operating noise passively transmitted into the passenger compartment on the signaled temperature.

2. The device according to claim 1, wherein the input is transmitted through a digital data bus.

3. The device according to claim 1, further comprising a mixer that is connected upstream of the loudspeaker and configured to superimpose the offsetting noise signal with an audio signal.

4. The device according to claim 1, wherein the noise signal generator is configured to independently control the volume for a plurality of frequency ranges.

5. The device according to claim 1, wherein the input for the temperature signal is connected to an oil temperature sensor.

6. The device according to claim 1, wherein the input for the temperature signal is connected to a plurality of temperature sensors arranged on an intake air line or an exhaust line.

7. The device according to claim 1, wherein the input for the temperature signal is connected to a plurality of temperature sensors arranged on an exhaust line.

* * * * *